US011342700B2

(12) United States Patent
Kim

(10) Patent No.: US 11,342,700 B2
(45) Date of Patent: May 24, 2022

(54) PLUG RECEIVING DEVICE

(71) Applicant: Hoyoung Kim, Ulsan (KR)

(72) Inventor: Hoyoung Kim, Ulsan (KR)

( * ) Notice: Subject to any disclaimer, the term of this patent is extended or adjusted under 35 U.S.C. 154(b) by 121 days.

(21) Appl. No.: 17/028,969

(22) Filed: Sep. 22, 2020

(65) Prior Publication Data

US 2021/0151921 A1 May 20, 2021

(30) Foreign Application Priority Data

Nov. 14, 2019 (KR) ..... 10-2019-0146140

(51) Int. Cl.

| | |
|---|---|
| ***H01R 11/30*** | (2006.01) |
| ***H01R 13/11*** | (2006.01) |
| ***H01R 13/62*** | (2006.01) |
| ***H01R 13/629*** | (2006.01) |

(52) U.S. Cl.

CPC ..... *H01R 13/111* (2013.01); *H01R 13/6205* (2013.01); *H01R 13/629* (2013.01)

(58) Field of Classification Search

CPC ..... H01R 13/111; H01R 13/6205; H01R 13/629; H01R 25/006; H01R 31/06; H02G 3/14

See application file for complete search history.

(56) References Cited

U.S. PATENT DOCUMENTS 4,038,505 A * 7/1977 Gasparaitis ..... H01R 13/629 439/152
4,070,557 A * 1/1978 Ostapovitch ..... H01R 13/629 361/787
6,120,320 A * 9/2000 Veiga ..... H01R 31/065 361/45
6,371,815 B1 4/2002 Wetzel et al.
7,052,298 B1 * 5/2006 Cheng ..... H01R 31/065 439/651

(Continued)

FOREIGN PATENT DOCUMENTS

CN 102957034 A 3/2013
KR 100333842 B1 4/2002

(Continued)

OTHER PUBLICATIONS

International Search Report dated Feb. 22, 2021 in PCT Application No. PCT/KR2020/015614, with no translation, 9 pages.

*Primary Examiner* — Thanh Tam T Le
(74) *Attorney, Agent, or Firm* — Kinney & Lange, P.A.

(57) ABSTRACT

A plug receiving device includes a main body having an inner space therein and having an open front face and an open top, wherein conductor pins to be inserted into pin holes of an outlet protrude from an outer rear face of the main body, wherein first electrical connectors are disposed on an inner rear face of the main body; a shield coupled to an inner rear face of the main body and having a vertically slidable slider; and a removable insert to be removably inserted into the inner space, wherein the removable insert has second electrical connectors disposed on an outer face thereof, wherein when the removable insert is inserted into the inner space such that the removable insert presses down the slider of the shield, the second electrical connectors are electrically connected to the first electrical connectors and then to the conductor pins, respectively.

9 Claims, 8 Drawing Sheets

(56) References Cited

U.S. PATENT DOCUMENTS

| | | | | |
|---|---|---|---|---|
| 7,726,973 | B1 * | 6/2010 | Perry | H01R 13/6205 439/39 |
| 8,197,265 | B1 * | 6/2012 | Lee | H01R 31/06 439/651 |
| 9,166,351 | B1 * | 10/2015 | Wang | H01R 24/66 |
| 10,199,785 | B2 * | 2/2019 | Higashiura | H01R 33/94 |
| 10,298,037 | B2 * | 5/2019 | Wang | H01R 13/6205 |
| 10,374,353 | B2 * | 8/2019 | Archuleta | H01F 7/0247 |
| 10,797,425 | B1 * | 10/2020 | Young | H01R 13/35 |
| 11,011,870 | B2 * | 5/2021 | Zhang | H01R 13/6205 |
| 2013/0052840 | A1 | 2/2013 | Wang et al. | |

FOREIGN PATENT DOCUMENTS

| | | | |
|---|---|---|---|
| KR | 200458169 | | 1/2012 |
| KR | 20160046421 | A | 4/2016 |
| KR | 20190001487 | A | 1/2019 |
| KR | 102151760 | B1 | 9/2020 |

* cited by examiner

【FIG. 1】
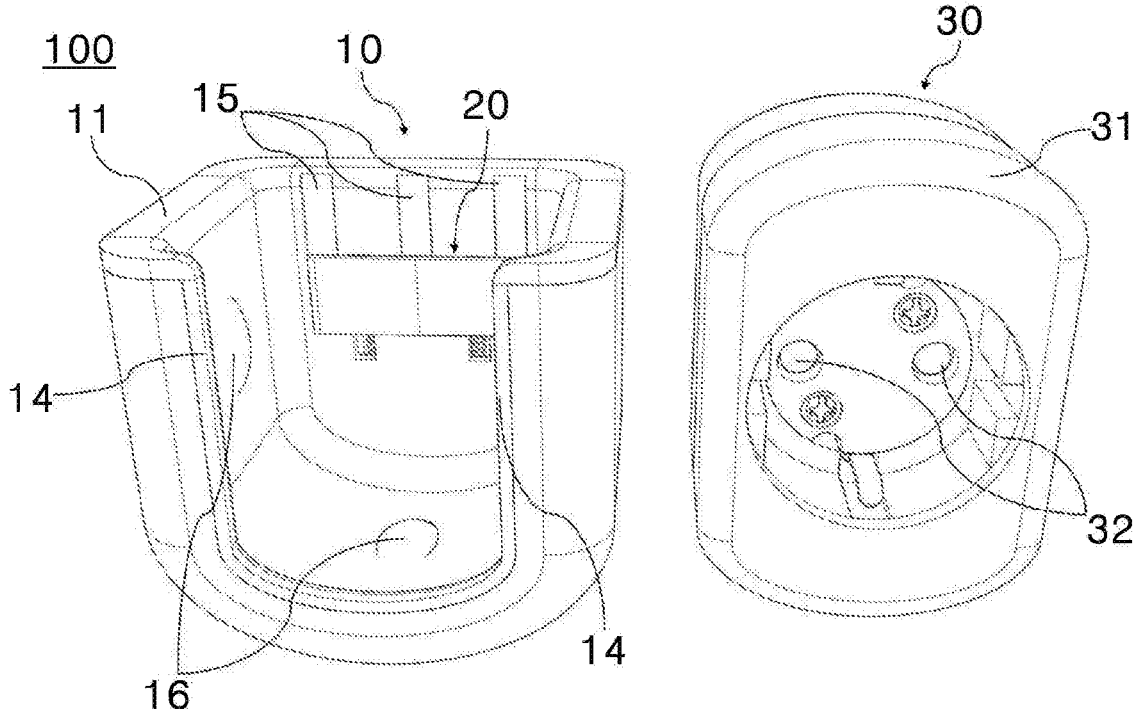

【FIG. 2】
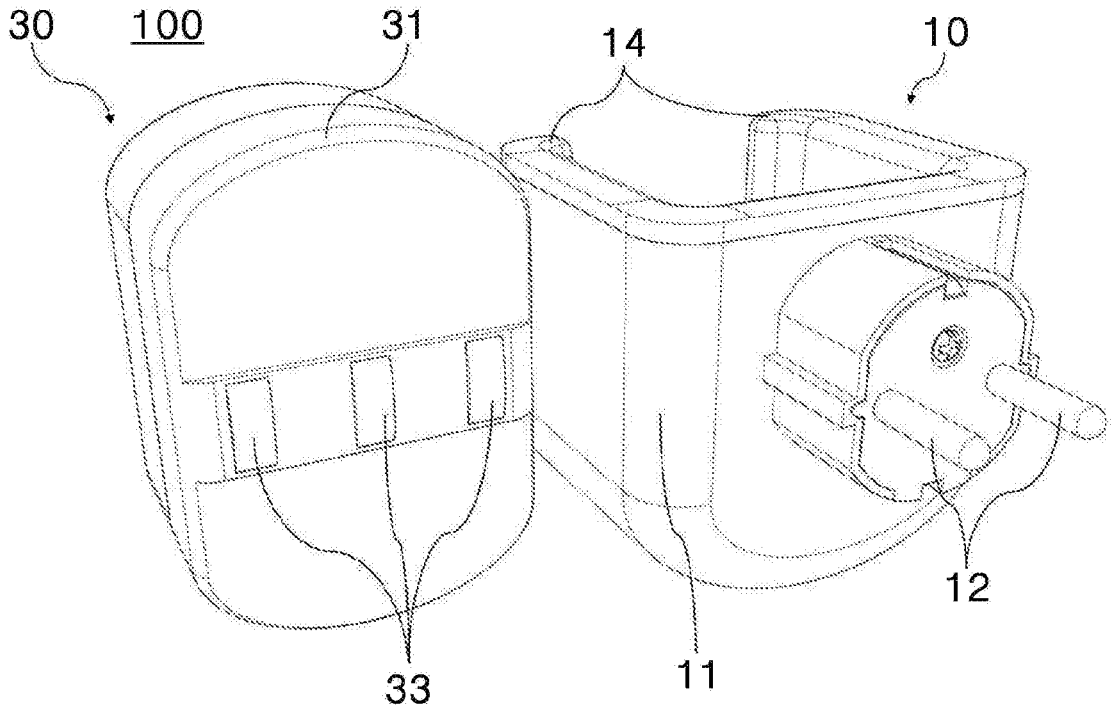

【FIG. 3】
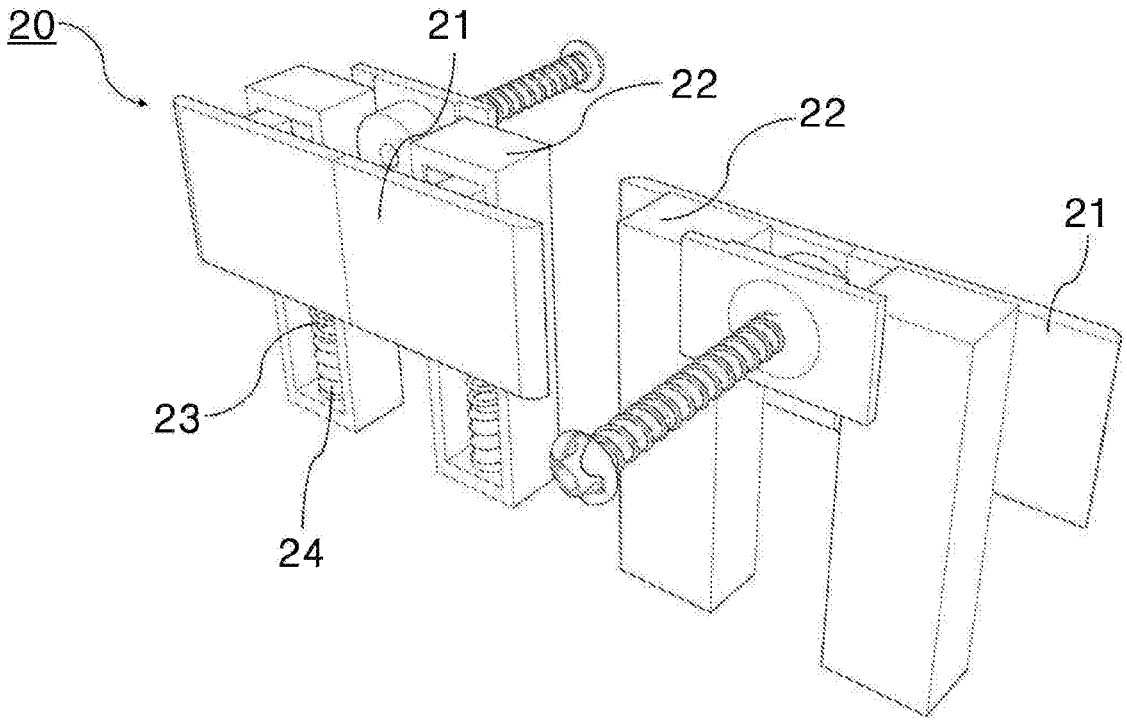

【FIG. 4】
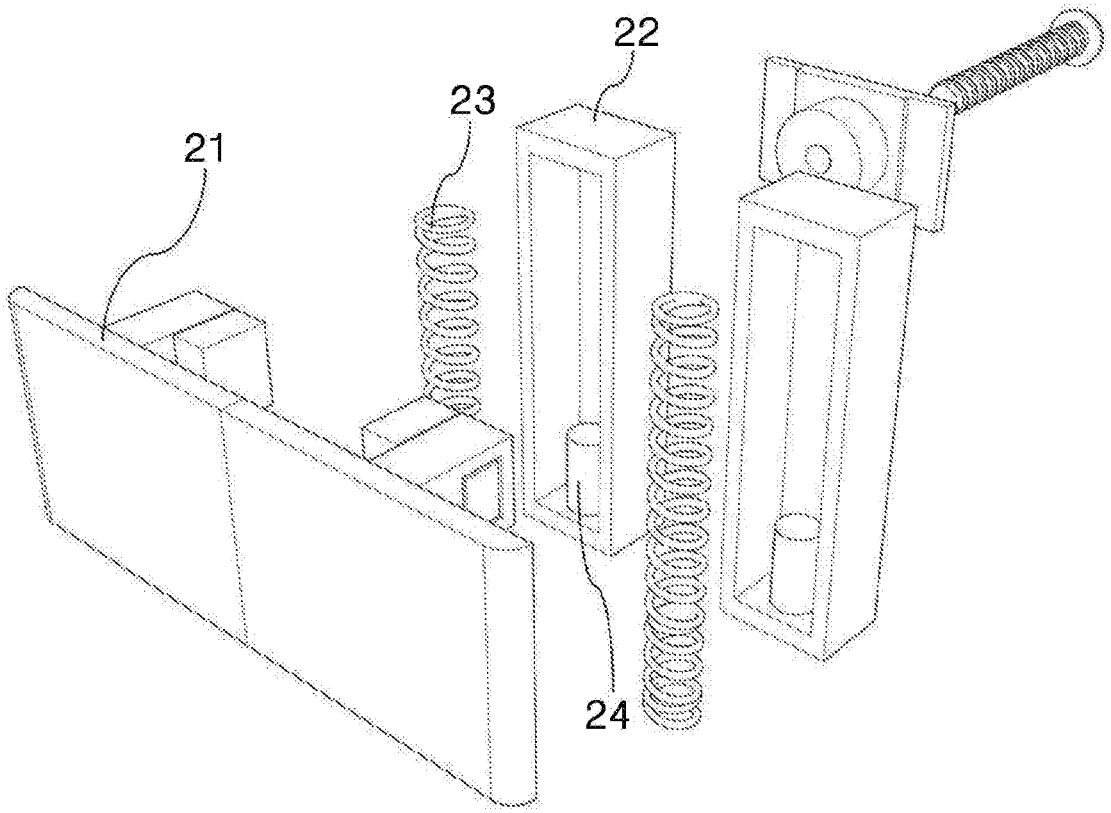

【FIG. 5】
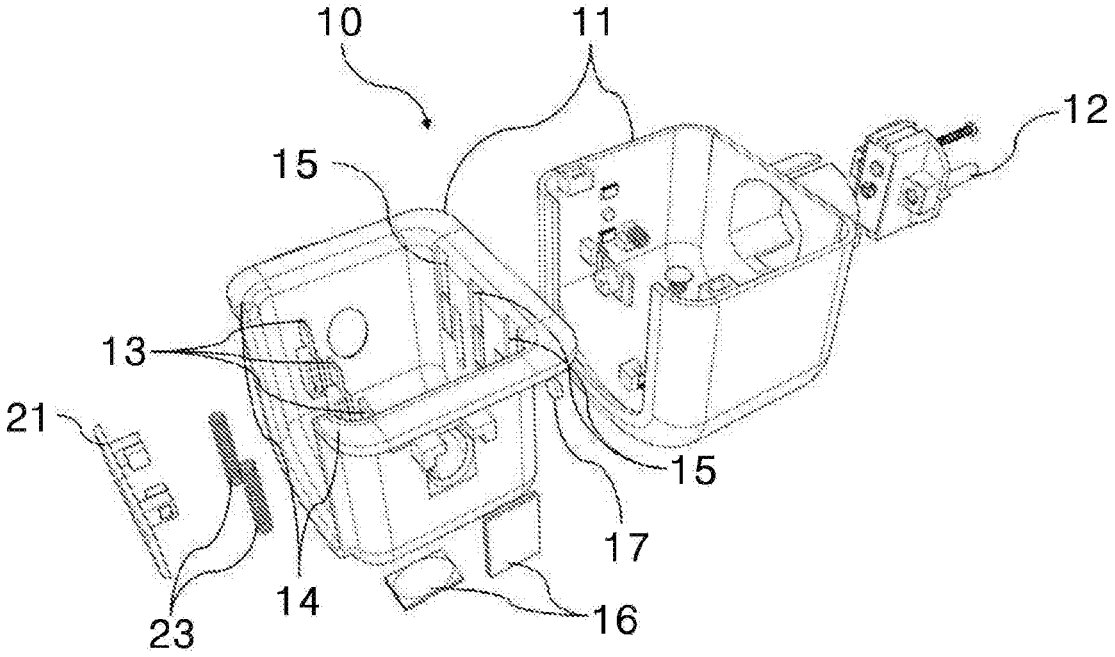

【FIG. 6】
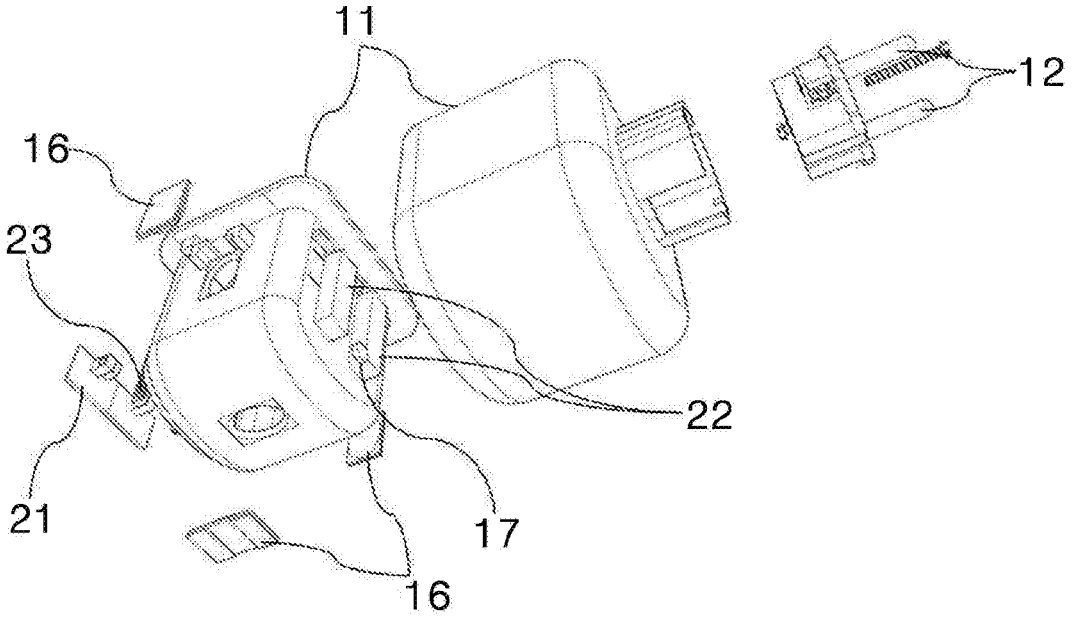

【FIG. 7】
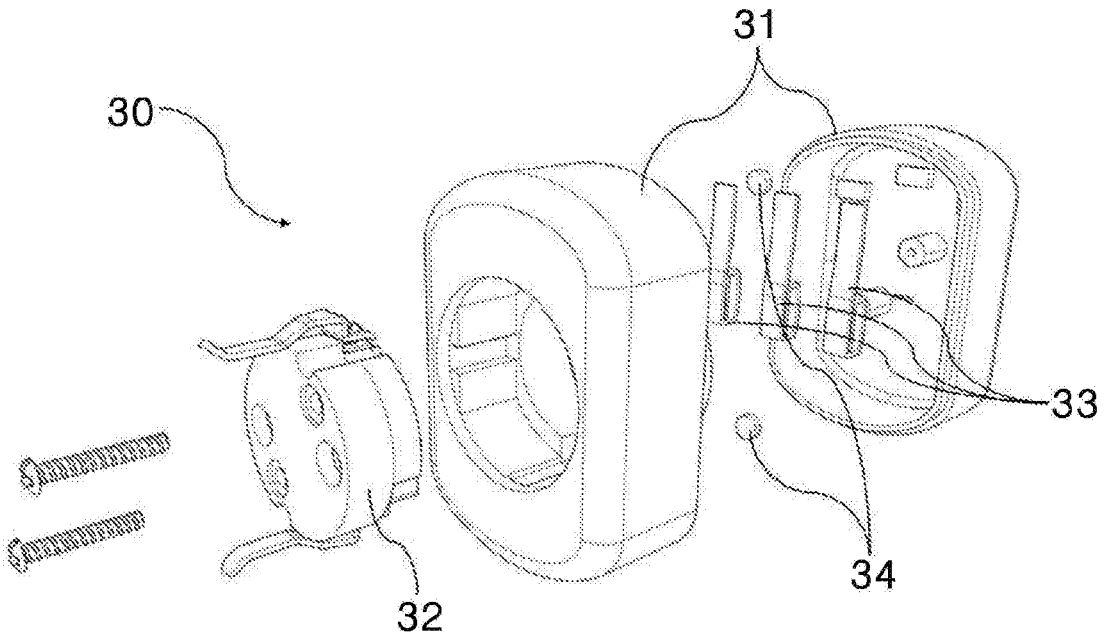

【FIG. 8】
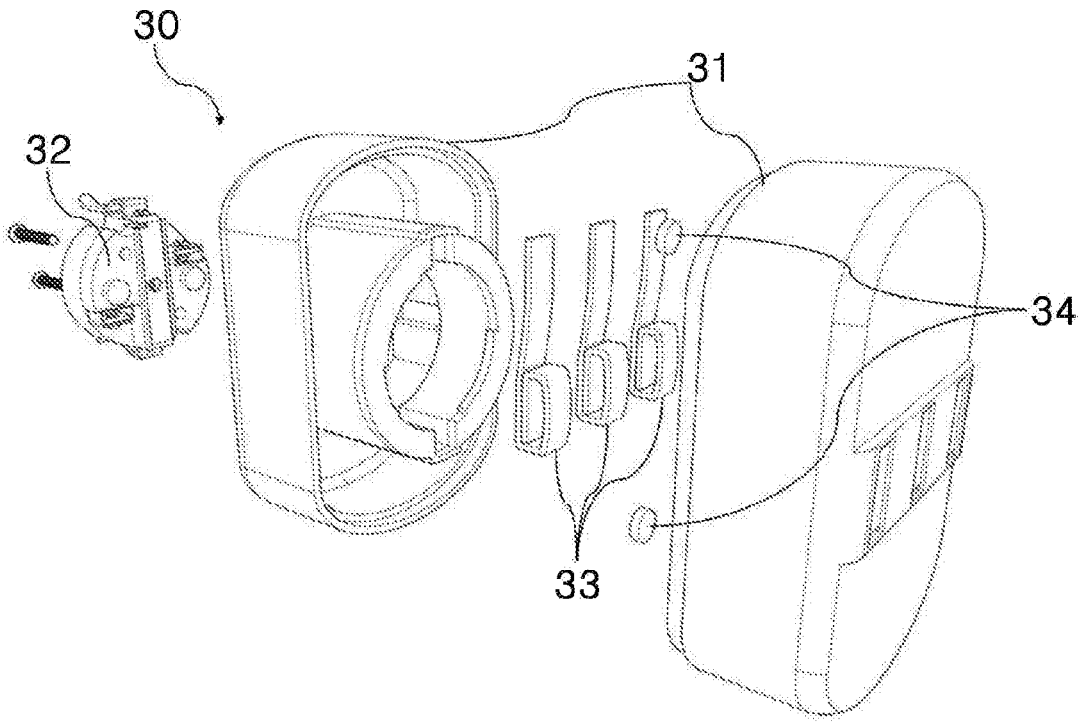

PLUG RECEIVING DEVICE

CROSS-REFERENCE TO RELATED APPLICATION

This application claims priority under 35 U.S.C. § 119(a) to Korean Patent Application No. 10-2019-0146140 filed on Nov. 14, 2019 in the Korean Intellectual Property Office, the entire disclosure of which is incorporated herein by reference for all purposes.

BACKGROUND

1. Technical Field

The present disclosure relates to a plug receiving device, and more particularly, to a plug receiving device with improved safety and convenience.

2. Description of Related Art

In general, a plug is attached at a distal end of a wire of an electronic product that uses commercial power. The plug is connected to an outlet to receive electricity therefrom.

The outlet is used to supply electric current to electronic devices such as various electronic products via electrical connection with the plug, and is usually embedded in a wall or has a form of a multi-tap which is movable while being connected to a power source.

The outlet embedded in the wall or the multi-tap type outlet is implemented so that plug-pins are inserted into outlet holes. This approach requires an excessive force from a user when the user inserts and separates the plug into or from the outlet. Further, in this conventional approach, a separate safety device is not provided, thereby to cause an electric shock accident, etc.

Prior art literature: Patent literature: Registered Korean Utility Model No. 20-0458169.

SUMMARY

This Summary is provided to introduce a selection of concepts in a simplified form that are further described below in the Detailed Description. This Summary is not intended to identify all key features or essential features of the claimed subject matter, nor is it intended to be used alone as an aid in determining the scope of the claimed subject matter.

The present disclosure is provided to solve the above-described problem. Thus, a purpose of the present disclosure is to provide a plug receiving device in which a user may easily insert or separate a plug of an electronic product into or from the device without applying excessive force, and, further, electric shock accident may be prevented.

Purposes of the present disclosure are not limited to the above-mentioned purpose. Other purposes and advantages of the present disclosure as not mentioned above may be understood from following descriptions and more clearly understood from embodiments of the present disclosure. Further, it will be readily appreciated that the purposes and advantages of the present disclosure may be realized by features and combinations thereof as disclosed in the claims.

One aspect of the present disclosure provides a plug receiving device comprising: a main body having an inner space therein and having an partially open front face and an open top, wherein conductor pins to be inserted into pin holes of an outlet protrude from an outer rear face of the main body, wherein first electrical connectors are disposed on an inner rear face of the main body; a shield coupled to an inner rear face of the main body and having a vertically slidable slider; and a removable insert to be removably inserted into the inner space in a vertical direction, wherein the removable insert has second electrical connectors disposed on an outer face thereof, wherein when the removable insert is not inserted into the inner space, the slider screens the first electrical connectors, wherein when the removable insert is inserted into the inner space in a downward direction such that the removable insert presses down the slider of the shield, the first electrical connectors are exposed due to downward movement of the slider and, at the same time, the second electrical connectors are electrically connected to the first electrical connectors and then to the conductor pins, respectively.

In one implementation, the first electrical connectors are electrically connected to the conductor pins, respectively.

In one implementation, the removable insert has plug-pin receiving holes defined in an inner front face thereof.

In one implementation, grooves extending in a vertical direction are defined in an inner rear face of the main body, wherein the first electrical connectors are positioned beneath the grooves, respectively, wherein when the removable insert is inserted into the main body downwardly, the second electrical connectors are guided along the grooves, respectively to push down the slider of the shield.

In one implementation, the shield includes: the slider slidable vertically along the inner rear face of the main body; a hollow slider support receiving therein a portion of the slider and coupled to the inner rear face of the main body and guiding the vertical movement of the slider; an elastic member received in the slider support and elastically supporting a bottom of the slider; and an elastic member support fixing a bottom of the elastic member.

In one implementation, as the second electrical connectors are downwardly guided along the grooves, the slider moves downwards.

In one implementation, both opposing extensions extend from front ends of both side walls of the main body in left and right directions, respectively, wherein the extensions 14 support a front face of the removable insert.

In one implementation, the main body receives at least one switch disposed on an inner side face or an inner bottom face of the main body, wherein when the removable insert is inserted into the main body, the at least one switch comes into contact with an outer side face or an outer bottom face of the removable insert and is pressed by the removable insert, thereby to electrically connect the second conductors of the removable insert and the conductor pins to each other.

In one implementation, a first magnet is coupled to an inner side face of the main body, and a second magnet acting an attractive force toward the first magnet is coupled to an inner side face of the removable insert.

Effects in accordance with the present disclosure may be as follows but may not be limited thereto.

According to the present disclosure, the user may merely insert the removable insert into the main body of the plug receiving device in a vertical direction without directly inserting the plug into the outlet hole, thereby to achieve electrical connection between the outlet and the electrical product.

Further, the electrical connectors of the main body are exposed only when the removable insert is inserted into the main body. Further, the plurality of switches disposed inside the main body are activated only when the removable insert is inserted into the main body. Thus, an electric shock accident may be prevented.

In addition to the effects as described above, specific effects in accordance with the present disclosure will be described together with the detailed description for carrying out the disclosure.

BRIEF DESCRIPTIONS OF DRAWINGS

FIG. 1 is a front perspective view of a plug receiving device according to an embodiment of the present disclosure.

FIG. 2 is a rear perspective view of a plug receiving device according to an embodiment of the present disclosure.

FIG. 3 is a perspective view of a shield according to an embodiment of the present disclosure.

FIG. 4 is an exploded perspective view of a shield according to an embodiment of the present disclosure.

FIG. 5 is an exploded perspective view in a first view angle of a main body and a shield according to an embodiment of the present disclosure.

FIG. 6 is an exploded perspective view in a second view angle of a main body and a shield in according to an embodiment of the present disclosure.

FIG. 7 is an exploded perspective view in a first view angle of a removable insert according to an embodiment of the present disclosure.

FIG. 8 is an exploded perspective view in a second view angle of a removable insert according to an embodiment of the present disclosure.

DETAILED DESCRIPTION

For simplicity and clarity of illustration, elements in the figures are not necessarily drawn to scale. The same reference numbers in different figures represent the same or similar elements, and as such perform similar functionality. Further, descriptions and details of well-known steps and elements are omitted for simplicity of the description. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

Examples of various embodiments are illustrated and described further below. It will be understood that the description herein is not intended to limit the claims to the specific embodiments described. On the contrary, it is intended to cover alternatives, modifications, and equivalents as may be included within the spirit and scope of the present disclosure as defined by the appended claims.

The terminology used herein is for the purpose of describing particular embodiments only and is not intended to limit the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, operations, elements, and/or components, but do not preclude the presence or addition of one or more other features, integers, operations, elements, components, and/or portions thereof. As used herein, the term "and/or" includes any and all combinations of one or more of the associated listed items. Expression such as "at least one of" when preceding a list of elements may modify the entire list of elements and may not modify the individual elements of the list.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

In addition, it will also be understood that when a first element or layer is referred to as being present "on" or "beneath" a second element or layer, the first element may be disposed directly on or beneath the second element or may be disposed indirectly on or beneath the second element with a third element or layer being disposed between the first and second elements or layers.

It will be understood that when an element or layer is referred to as being "connected to", or "coupled to" another element or layer, it may be directly on, connected to, or coupled to the other element or layer, or one or more intervening elements or layers may be present. In addition, it will also be understood that when an element or layer is referred to as being "between" two elements or layers, it may be the only element or layer between the two elements or layers, or one or more intervening elements or layers may also be present.

Further, as used herein, when a layer, film, region, plate, or the like is disposed "on" or "on a top" of another layer, film, region, plate, or the like, the former may directly contact the latter or still another layer, film, region, plate, or the like may be disposed between the former and the latter. As used herein, when a layer, film, region, plate, or the like is directly disposed "on" or "on a top" of another layer, film, region, plate, or the like, the former directly contacts the latter and still another layer, film, region, plate, or the like is not disposed between the former and the latter. Further, as used herein, when a layer, film, region, plate, or the like is disposed "below" or "under" another layer, film, region, plate, or the like, the former may directly contact the latter or still another layer, film, region, plate, or the like may be disposed between the former and the latter. As used herein, when a layer, film, region, plate, or the like is directly disposed "below" or "under" another layer, film, region, plate, or the like, the former directly contacts the latter and still another layer, film, region, plate, or the like is not disposed between the former and the latter.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a front perspective view of a plug receiving device 100 according to an embodiment of the present disclosure. FIG. 2 is a rear perspective view of the plug receiving device 100 according to an embodiment of the present disclosure. FIG. 3 is a perspective view of a shield 20 according to an embodiment of the present disclosure. FIG. 4 is an exploded perspective view of the shield 20 according to an embodiment of the present disclosure. FIG. 5 is an exploded perspective view in a first view angle of a main body 10 and the shield 20 according to an embodiment of the present disclosure. FIG. 6 is an exploded perspective view in a second view angle of the main body 10 and the shield 20 according to an embodiment of the present disclosure. FIG. 7 is an exploded perspective view in a first view angle of a removable insert 30 according to an embodiment of the present disclosure. FIG. 8 is an exploded perspective view in a second view angle of the removable insert 30 according to an embodiment of the present disclosure viewed from a different angle.

Referring to FIG. 1 and FIG. 2, the plug receiving device 100 according to an embodiment of the present disclosure includes a hollow main body 10, a shield 20, and a removable insert 30. Conductor pins 12 to be inserted into holes of an outlet (not shown) protrude from an outer rear face of the main body 10. A front face of the main body 10 is partially open and a top of the main body 10 is open. The shield 20 is coupled to an inner rear face of the main body 10 and including a slider. The removable insert 30 is detachably inserted into an inner space of the main body 10 vertically. The removable insert 30 is electrically connected to the conductor pins 12 when a slider of the shield 20 slides downwards.

In this connection, the main body 10 includes a body housing 11. The body housing 11 may define an overall appearance of the main body 10. Further, the shield 20 may be coupled to the inner rear face of the body housing 11. Side and bottom faces of the removable insert 30 may be supported on the body housing 11 while the removable insert 30 is inserted into the main body 10.

Further, the body housing 11 may be made of a non-electrical material to prevent electrical connection thereof to the conductor pins 12, first electrical connectors 13 and second electrical connectors 33 to be described later. In this connection, the body housing 11 may be made of a material such as synthetic plastic, but is not limited thereto.

In one example, the aforementioned outlet may be embedded in a wall of a building, etc. The conductor pins 12 may be inserted into the holes of the outlet.

Referring to FIG. 1 and FIG. 2, the above-described removable insert 30 may be inserted into the main body 10 in the vertical direction and may include an insert housing 31 forming an overall appearance of the removable insert 30.

Further, the removable insert 30 may have plug-pin receiving holes 32 defined in a rear face thereof into which conductor pins of a plug (not shown) of an electronic product are inserted. In this connection, the removable insert 30 may include a plurality of removable inserts 30. Thus, plugs of plurality of electronic products may be coupled to the plurality of removable inserts 30, respectively. Thus, a plug of an electronic product coupled to a removable insert as selected by the user among the plurality of the plugs may be inserted into the main body 10.

Further, the plug-pin receiving holes 32 may be defined in a separate plate which in turn may be fastened to the removable insert housing 31 in a screw coupling manner. The pins of the plug of the electronic product may be inserted into the plug-pin receiving holes 32 before the removable insert 30 is inserted into the main body 10. Alternatively, the pins of the plug of the electronic product may be inserted into the plug-pin receiving holes 32 after the insert 30 is fully inserted into the main body 10.

The aforementioned removable insert 30 is detachable from the main body 10 and is a separate component therefrom. Thus, the electronic product may be easily turned on by the user simply inserting the removable insert 30 into the main body 10 in the vertical direction without directly inserting the plug into the outlet embedded in the wall.

Further, referring to FIG. 1, FIG. 2, FIG. 5, and FIG. 6, both opposing extensions 14 extend from front ends of both side walls of the main body 10 in left and right directions, respectively. The extensions 14 may support the front face of the removable insert 30 while the removable insert 30 is fully inserted into the main body 10, and may prevent the removable insert 30 from being removed from the main body 10 in a front direction.

Referring to FIG. 1, FIG. 2, and FIG. 5 to FIG. 8, the first electrical connectors 13 exposed when the slider 21 of the shield 20 moves downward may be coupled to the inner rear face of the main body 10. Further, the first electrical connectors 13 and the conductor pins 12 may be electrically connected to each other, respectively. In this connection, although not shown, the first electrical connectors 13 and the conductor pins 12 may be connected to each other by wires or the like.

Further, the removable insert 30 have the second electrical connectors 33 contacting the first electrical connectors 13. The first electrical connectors 13 and the second electrical connectors 33 as described above may be electrically connected to each other when the removable insert 30 is inserted into the main body 10 while pressing the slider 21 of the shield 20.

The removable insert 30 may move inside the main body along grooves 15 defined in the inner rear face of the main body 10 in the vertical direction. In this connection, the first electrical connectors 13 may be disposed under the grooves 15. The second electrical connectors 33 may be guided along the grooves 15 when the removable insert 30 is inserted into the main body 10, thereby to allow the slider 21 of the shield 20 to move downwards.

As shown in FIG. 3 to FIG. 6, the shield 20 may include the slider 21 sliding vertically along the inner rear face of the main body 10, a hollow slider support 22 coupled to the inner rear face of the main body 10 and guiding the vertical movement of the slider 21, an elastic member 23 received in the slider support 22 on a bottom face thereof and applying elastic force to the slider 21 when the slider 21 moves up and down, and an elastic member support 24 that supports a bottom of the elastic member 23.

In this connection, the second electrical connectors 33 as described above are guided along the grooves 15 when the removable insert 30 is inserted into the main body 10, thereby to press down the slider 21 of the shield 20 so that the slider 21 may be moved downward. Further, the second electrical connectors 33 may be guided along the grooves 15 and may be moved in the vertical direction. Thus, the user may insert the removable insert 30 into the main body 10 only using smaller force.

When the second electrical connectors 33 press the slider 21, the elastic member 23 received in the slider support 22 may be compressed. In this connection, the elastic member support 24 protruding upward is inserted into the elastic member 23.

As described above, when the second electrical connectors 33 are guided along the grooves 15 and then push down the slider 21 to move the slider 21 downwards, the first electrical connectors 13 that have been screened by the slider 21 may be exposed to the outside. In this connection, the first electrical connectors 13 and the second electrical connectors 33 may be electrically connected to each other, respectively. Thus, power may be supplied from the outlet through the conductor pins 12, the first electrical connectors 13, and then the second electrical connectors 33 to the plug of the electronic product.

Further, the removable insert 30 is formed symmetrically in a vertical direction, and the second electrical connector 33 is formed on a center of an outer rear face of the removable insert 30. Thus, the first electrical connectors 13 and the second electrical connectors 33 may be electrically connected to each other, respectively when any one of the bottom and the top of the removable insert 30 is first inserted into the main body 10.

When the insert is removed from the main body 10 in an upward direction, the second electrical connectors 33 are moved upwards along the grooves 15, and thus the electrical connection between the first electrical connectors 13 and the second electrical connectors 33 may be disabled. Further, as the elastic member 23 compressed by the downward movement of the second electrical connectors 33 is restored, the slider 21 ascends, and thus the first electrical connectors 13 may be invisible to the user via the slider 21.

Due to the above configuration, when the user inserts the removable insert 30 into the main body 10, only the simple and easy operation of the user inserting the removable insert 30 into the main body vertically in a direction of gravity is required to supply the power to the electronic product.

Further, when the removable insert 30 is not inserted into the main body 10, the slider 21 of the shield 20 shields the first electrical connectors 13. Thus, the electric shock accident may be prevented. Further, this prevents fire accidents due to static electricity which may be otherwise generated via dust accumulation on the first electrical connectors 13.

As shown in FIG. 1, FIG. 5, and FIG. 6, the main body 10 may further receive at least one switch 16 disposed on an inner side face or an inner bottom face of the main body 10. When the removable insert 30 is inserted into the main body 10, the at least one switch 16 comes into contact with an outer side face or an outer bottom face of the removable insert 30 and is pressed by the removable insert 30, thereby to electrically connect the conductors of the removable insert 30 and the conductor pins 12 to each other.

The number of the first electrical connectors 13 may three as shown in FIG. 5. However, the present disclosure is not limited thereto. The number of the grooves 15 beneath with the first electrical connectors 13 are disposed respectively may be three as shown in FIG. 1 and FIG. 5.

Further, as shown in FIG. 5 and FIG. 6, a first switch is disposed on the inner bottom face of the main body 10. When the first switch is turned on, a first middle electrical connector beneath a middle groove of the three grooves 15 may be electrically connected to a ground terminal via a wire (not shown).

Second and third switches are respectively disposed on both inner side faces of the main body 10. When the second and third switches are turned on, first left and right electrical connectors beneath left and right grooves of the three grooves 15 respectively may be electrically connected to two corresponding conductor pins 12 via two corresponding wires (not shown) respectively.

In another example, when the first and second switches are turned on, the first left electrical connector beneath the left groove of the three grooves 15 may be electrically connected to a corresponding conductor pin 12 via a corresponding wire (not shown). When the first and third switches are turned on, the first right electrical connector beneath the right groove of the three grooves 15 may be electrically connected to a corresponding conductor pin 12 via a corresponding wire (not shown). In this connection, the first middle electrical connector beneath the middle groove of the three grooves 15 may be directly connected to the ground terminal without a separate connection to the switch.

The electrical connections via the three switches as described above may be configured in various combinations that may be considered by a person skilled in the art.

When the removable insert 30 is inserted into the main body 10, the three switches 16 may be in contact with the outer side faces and the outer bottom face of the removable insert 30, respectively and thus may be turned on.

In this connection, when the removable insert 30 is inserted into the main body 10, the switches 16 are turned on and, at the same time, the slider 21 of the shield 20 moves downwards. Thus, the first electrical connectors 13 and the second electrical connectors 33 of the removable insert 30 may be electrically connected to each other, respectively. As the switches 16 are turned on via the insertion of the removable insert 30 into the main body 10, the electrical connections between the first electrical connectors 13 and the conductor pins 12 respectively may be established. Eventually, the electrical connections between the second electrical connectors 33 of the removable insert 30 and the conductor pins 12 respectively may be established.

The switches 16 are turned on only when the removable insert 30 is inserted into the main body 10. Thus, the second electrical connectors 33 of the removable insert 30 and the conductor pins 12 are electrically connected to each other. Thus, the electric shock accident may be prevented.

Further, as shown in FIG. 6 and FIG. 7, a first magnet 17 is coupled to the main body 10. Specifically, the first magnet 17 is disposed between the slider supports 22 inside the body housing 11, as shown in FIG. 6. A second magnet 34 acting an attractive force toward the first magnet 17 is coupled to an inner side face of the removable insert 30. In this connection, the first magnet 17 and the second magnet 34 may include permanent magnets such as neodymium magnets. Different polarities thereof may face each other and thus mutual attraction therebetween may act.

Due to the configuration of the first magnet 17 and the second magnet 34 as described above, when the removable insert 30 is inserted into the main body 10, the attractive force between the first magnet 17 and the second magnet 34 may facilitate the contact between the removable insert 30 and the main body 10. Accordingly, the second electrical connectors 33 which are inserted and guided through the grooves 15, respectively may be brought into contact with the first electrical connectors 13 more easily.

According to the present disclosure, the user may merely insert the removable insert into the main body of the plug receiving device in a vertical direction without directly inserting the plug into the outlet hole, thereby to achieve electrical connection between the outlet and the electrical product.

Further, the electrical connectors of the main body are exposed only when the removable insert is inserted into the main body. Further, the plurality of switches disposed inside the main body are activated only when the removable insert is inserted into the main body. Thus, an electric shock accident may be prevented.

The present disclosure as described above may be subjected to various substitutions, modifications, and changes within the scope of the present disclosure without departing from the technical spirit of the present disclosure by a person having ordinary knowledge in the technical field to which the present disclosure belongs. Thus, the disclosure is not limited to the accompanying drawings.

What is claimed is:

1. A plug receiving device comprising:

a main body having an inner space therein and having an partially open front face and an open top, wherein conductor pins configured to be inserted into pin holes of an outlet protrude from an outer rear face of the main body, and wherein first electrical connectors are disposed on an inner rear face of the main body;

a shield coupled to an inner rear face of the main body and having a vertically slidable slider; and a removable insert configured to be removably inserted into the inner space in a vertical direction, wherein the removable insert has second electrical connectors disposed on an outer face thereof, wherein when the removable insert is not inserted into the inner space, the slider screens the first electrical connectors, and wherein when the removable insert is inserted into the inner space in a downward direction such that the removable insert presses down the slider of the shield, the first electrical connectors are exposed due to downward movement of the slider and, at the same time, the second electrical connectors are electrically connected to the first electrical connectors and then to the conductor pins, respectively.

2. The plug receiving device of claim 1, wherein the first electrical connectors are electrically connected to the conductor pins, respectively.

3. The plug receiving device of claim 2, wherein the removable insert has plug-pin receiving holes defined in an inner front face thereof.

4. The plug receiving device of claim 3, wherein grooves extending in a vertical direction are defined in an inner rear face of the main body, wherein the first electrical connectors are positioned beneath the grooves, respectively, and wherein when the removable insert is inserted into the main body downwardly, the second electrical connectors are guided along the grooves, respectively to push down the slider of the shield.

5. The plug receiving device of claim 4, wherein the shield includes:

the slider slidable vertically along the inner rear face of the main body;

a hollow slider support receiving therein a portion of the slider and coupled to the inner rear face of the main body and guiding the vertical movement of the slider;

an elastic member received in the slider support and elastically supporting a bottom of the slider; and an elastic member support fixing a bottom of the elastic member.

6. The plug receiving device of claim 5, wherein as the second electrical connectors are downwardly guided along the grooves, the slider moves downwards.

7. The plug receiving device of claim 1, wherein two opposing extensions extend from front ends of both side walls of the main body in left and right directions, respectively, wherein the extensions support a front face of the removable insert.

8. The plug receiving device of claim 1, wherein the main body receives at least one switch disposed on an inner side face or an inner bottom face of the main body, and wherein when the removable insert is inserted into the main body, the at least one switch comes into contact with an outer side face or an outer bottom face of the removable insert and is pressed by the removable insert, thereby to electrically connect the second conductors of the removable insert and the conductor pins to each other.

9. The plug receiving device of claim 1, wherein a first magnet is coupled to an inner side face of the main body, and a second magnet having an attractive force toward the first magnet is coupled to an inner side face of the removable insert.

* * * * *